US009067715B2

(12) United States Patent
Lee et al.

(10) Patent No.: US 9,067,715 B2
(45) Date of Patent: Jun. 30, 2015

(54) BOTTLE CAP

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 795 days.

(21) Appl. No.: 13/055,008

(22) PCT Filed: Jul. 18, 2008

(86) PCT No.: PCT/KR2008/004210

§ 371 (c)(1),
(2), (4) Date: Jan. 20, 2011

(87) PCT Pub. No.: WO2009/014351

PCT Pub. Date: Jan. 29, 2009

(65) Prior Publication Data

US 2011/0163103 A1 Jul. 7, 2011

(30) Foreign Application Priority Data

| | | |
|---|---|---|
| Jul. 23, 2007 | (KR) | 10-2007-0074297 |
| Jul. 27, 2007 | (KR) | 10-2007-0075683 |
| Aug. 13, 2007 | (KR) | 10-2007-0082523 |
| Dec. 17, 2007 | (KR) | 10-2007-0134871 |

(51) Int. Cl.

| | |
|---|---|
| ***B65D 51/00*** | (2006.01) |
| ***B65D 41/04*** | (2006.01) |
| ***B65D 41/34*** | (2006.01) |
| ***B65D 41/46*** | (2006.01) |
| ***B65D 51/28*** | (2006.01) |

(52) U.S. Cl.

CPC ..... *B65D 51/00* (2013.01); *B65D 41/0421* (2013.01); *B65D 41/3428* (2013.01); *B65D 41/465* (2013.01); *B65D 51/2864* (2013.01); *B65D 2101/003* (2013.01); *B65D 2251/08* (2013.01); *B65D 41/0492* (2013.01)

(58) Field of Classification Search

CPC .. A61J 9/008; B65D 51/2864; B65D 51/2878
USPC ..... 220/287, 521, 522; 215/228, 229
See application file for complete search history.

(56) References Cited

U.S. PATENT DOCUMENTS

| | | | | |
|---|---|---|---|---|
| 2,076,457 | A * | 4/1937 | Genone | 141/381 |
| 2,447,581 | A * | 8/1948 | Keith | 215/228 |
| 3,690,496 | A * | 9/1972 | Gibson | 215/217 |
| 3,734,332 | A * | 5/1973 | Grulich | 215/208 |
| 3,827,593 | A * | 8/1974 | Kramb et al. | 215/208 |
| 4,147,268 | A * | 4/1979 | Patel et al. | 215/252 |
| 4,202,456 | A * | 5/1980 | Silber | 215/228 |
| 4,266,813 | A * | 5/1981 | Oliver | 285/12 |

(Continued)

FOREIGN PATENT DOCUMENTS

| | | |
|---|---|---|
| JP | 018551 | 3/1973 |
| KR | 20070062377 | 6/2007 |

OTHER PUBLICATIONS

International Search Report for PCT/KR2008/004210 filed Jul. 18, 2008; mailed Dec. 16, 2008; 2 pages.

*Primary Examiner* — Fenn Mathew
*Assistant Examiner* — Christopher McKinley
(74) *Attorney, Agent, or Firm* — Westman, Champlin & Koehler, P.A.

(57) ABSTRACT

The bottle cap, this invention, is designed to be suitable for the container necks of different size. As recommended, the bottle cap with two connection sections may be assembled in the container necks showing the different sizes of 26.78 MM and 28.0 MM.

10 Claims, 6 Drawing Sheets

(56) References Cited

U.S. PATENT DOCUMENTS

| | | | | | |
|---|---|---|---|---|---|
| 4,747,501 | A | * | 5/1988 | Greaves | 215/253 |
| 5,037,406 | A | * | 8/1991 | Smith et al. | 604/301 |
| 5,105,956 | A | * | 4/1992 | Tarng-Lin | 215/11.1 |
| 5,295,597 | A | * | 3/1994 | Green | 215/11.4 |
| 5,340,228 | A | * | 8/1994 | Wilcox et al. | 401/262 |
| 5,464,110 | A | * | 11/1995 | Heyworth | 215/223 |
| 5,465,835 | A | * | 11/1995 | Schumacher et al. | 206/221 |
| 5,769,263 | A | * | 6/1998 | Willingham et al. | 220/522 |
| 6,390,315 | B1 | * | 5/2002 | Giddings et al. | 215/235 |
| 6,415,937 | B1 | * | 7/2002 | DeJong et al. | 215/386 |
| 6,523,720 | B1 | * | 2/2003 | Robbins, III | 222/1 |
| 6,877,626 | B2 | * | 4/2005 | Sherrod | 215/319 |
| 7,198,162 | B2 | * | 4/2007 | Francois et al. | 215/329 |
| 8,215,505 | B2 | * | 7/2012 | Lee et al. | 215/228 |
| 2004/0124170 | A1 | * | 7/2004 | Sherrod | 215/319 |
| 2007/0095778 | A1 | * | 5/2007 | Catton | 215/11.1 |
| 2009/0120894 | A1 | * | 5/2009 | Kario et al. | 215/11.1 |

* cited by examiner

BOTTLE CAP

CROSS-REFERENCE TO RELATED APPLICATION

The present application is a Section 371 National Stage Application of International patent application Serial No. PCT/KR2008/004210, filed Jul. 18, 2008 and published as WO 2009/014351 on Jan. 29, 2009, in English the content of which is hereby incorporated by reference in its entirety.

TECHNICAL FIELD

This invention is on the bottle cap. In detail, this invention is on the new type bottle cap designed to be suitable for the diverse containers of different size and shape.

The purpose of this invention is to enable its users to easily assemble the bottle cap used to contain and seal the secondary material in the container neck of different size.

BACKGROUND TECHNOLOGIES

The general bottle cap may be assembled only in the container neck of same size in principle.

The bottle cap must guarantee the perfect airtight performance. However, the appropriate assembly or excellent airtight performance is not guaranteed if the size of screw threads mounted in the bottle cap or container neck is different.

For the specific bottle cap, there are two connection sections in the interior side and exterior side of a bottle cap. However, this design is acceptable only when the interior side is narrow and exterior side is wide, but this design is not acceptable if the size of container neck is different which is acceptable to this invention. The purpose of this invention is to solve above technical problems.

DETAILED DESCRIPTIONS OF INVENTION

Technical Problems

For an example, if the sizes of specific container necks are 26.78 mm and 28.00 mm, it is impossible to completely seal the container necks of different size with a common bottle cap. However, this invention guarantees the perfect airtight performance by installing the top connection section and bottom connection section to be connected to the container neck in the interior side of bottle cap.

Another purpose of this invention is to enable its users to assemble a bottle cap in the container necks of different size without any additional bottle caps.

How to Technically Solve the Problems

The bottle cap, created through this invention and intended to accomplish above purposes, is designed to mix and drop the secondary materials in the container when opened or touched after being combined into the container neck. In detail, the bottle cap consists of two connection sections positioned in the interior side contacting the screw thread of container neck.

Two connection sections of this invention are positioned in the interior side. However, top connection section forms the connection section suitable for the narrow area and bottom connection section forms the connection section suitable for the wide area respectively.

Top connection section forms the connection section suitable for the size of 26.78 mm and bottom connection section forms the connection section suitable for the size of 28.00 mm.

Above connection sections of bottle cap are designed to accomplish the intended purpose after being assembled as the connection sections.

EXPECTED EFFECTS

This invention enable its users to accomplish the intended purpose by being assembled in the container necks of different size without any additional bottle caps, so its sales shop may reduce the management cost by simplifying the sales items and its user may conveniently uses this invention without any additional instruction because he or she may assemble the bottle cap in the similar containers.

Especially, this invention is characterized by its excellent features of enabling the use of a bottle cap regardless of different size of 26.78 MM or 28.0 MM and drink of secondary material after opening the bottle cap.

BRIEF DESCRIPTION OF THE DRAWINGS

The FIG. 1 shows that the bottle cap is assembled in the wide container neck.

The FIG. 2 shows that the bottle cap is assembled in the narrow container neck.

Figure 3:
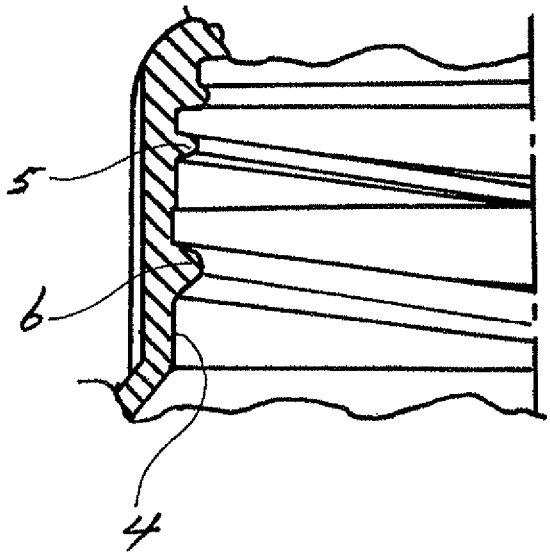
Figure 4:
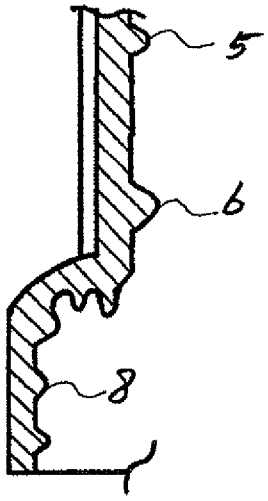

The FIG. 3 shows how the connection sections (top connection section and bottom connection section) are assembled in the container necks of different size.

The FIGS. 4 thru 7 show how the connection sections (top connection section, bottom connection section and accessory connection section) are transformed.

Figure 8:
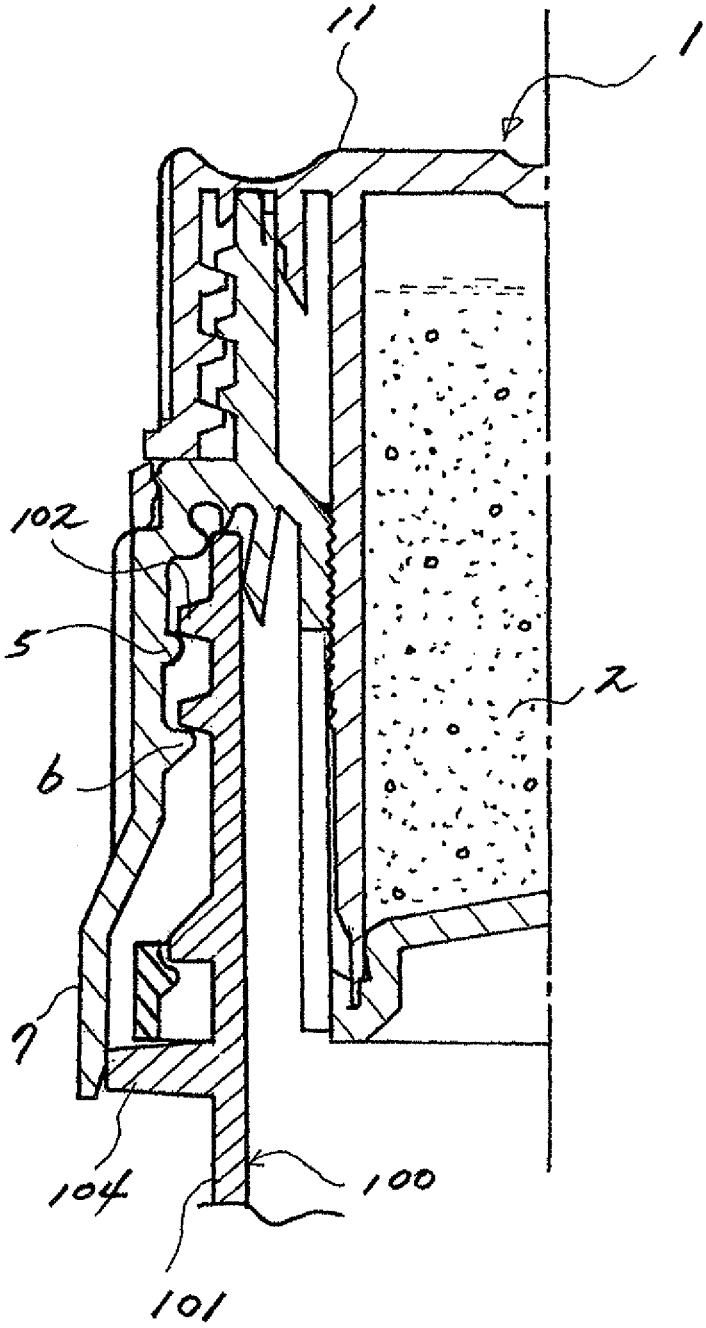
Figure 9:
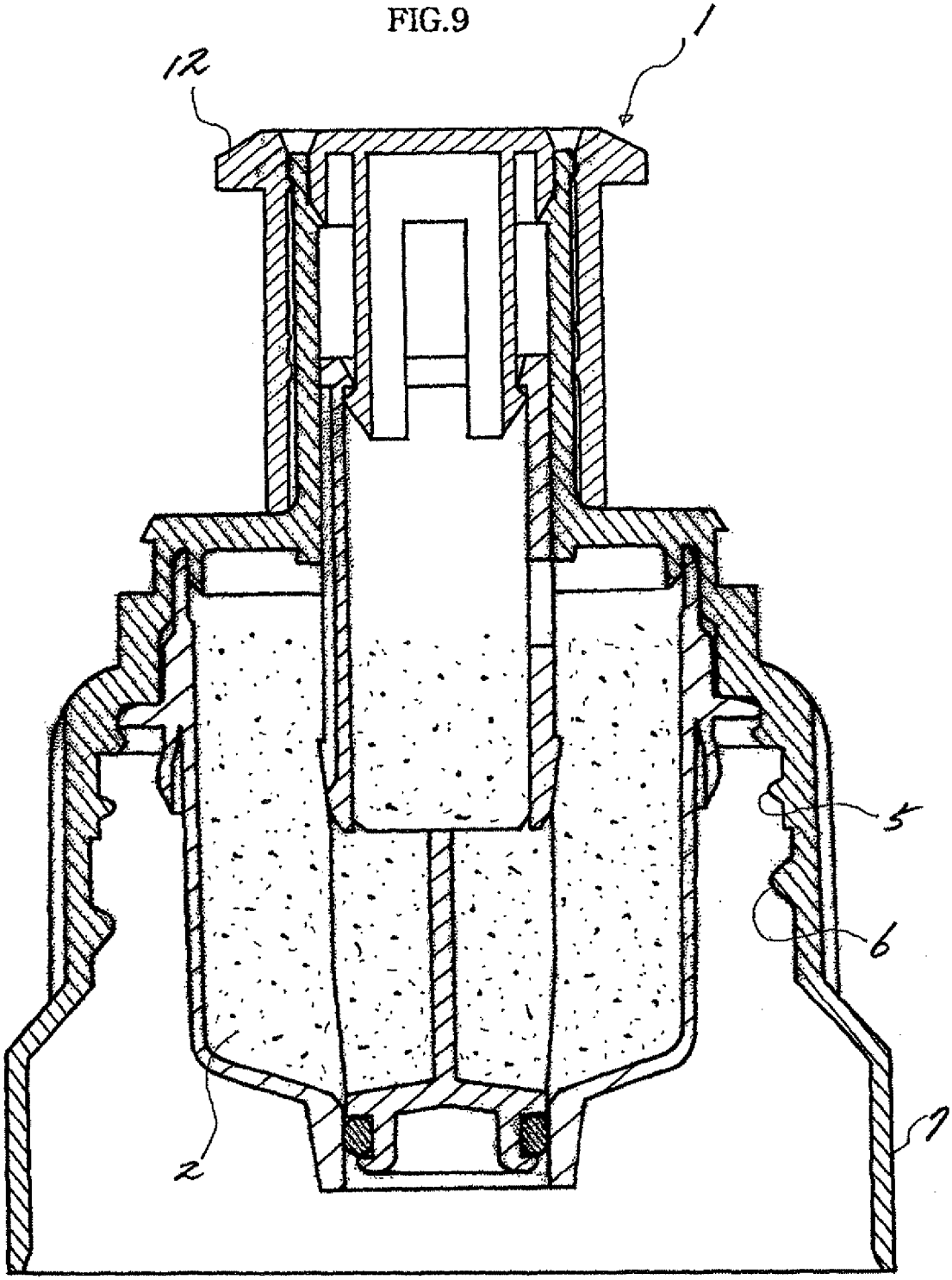

The FIGS. 8 and 9 show that the design of bottle cap may be diversely changed.

BEST MODE FOR CARRYING OUT THE INVENTION

Figure 1:
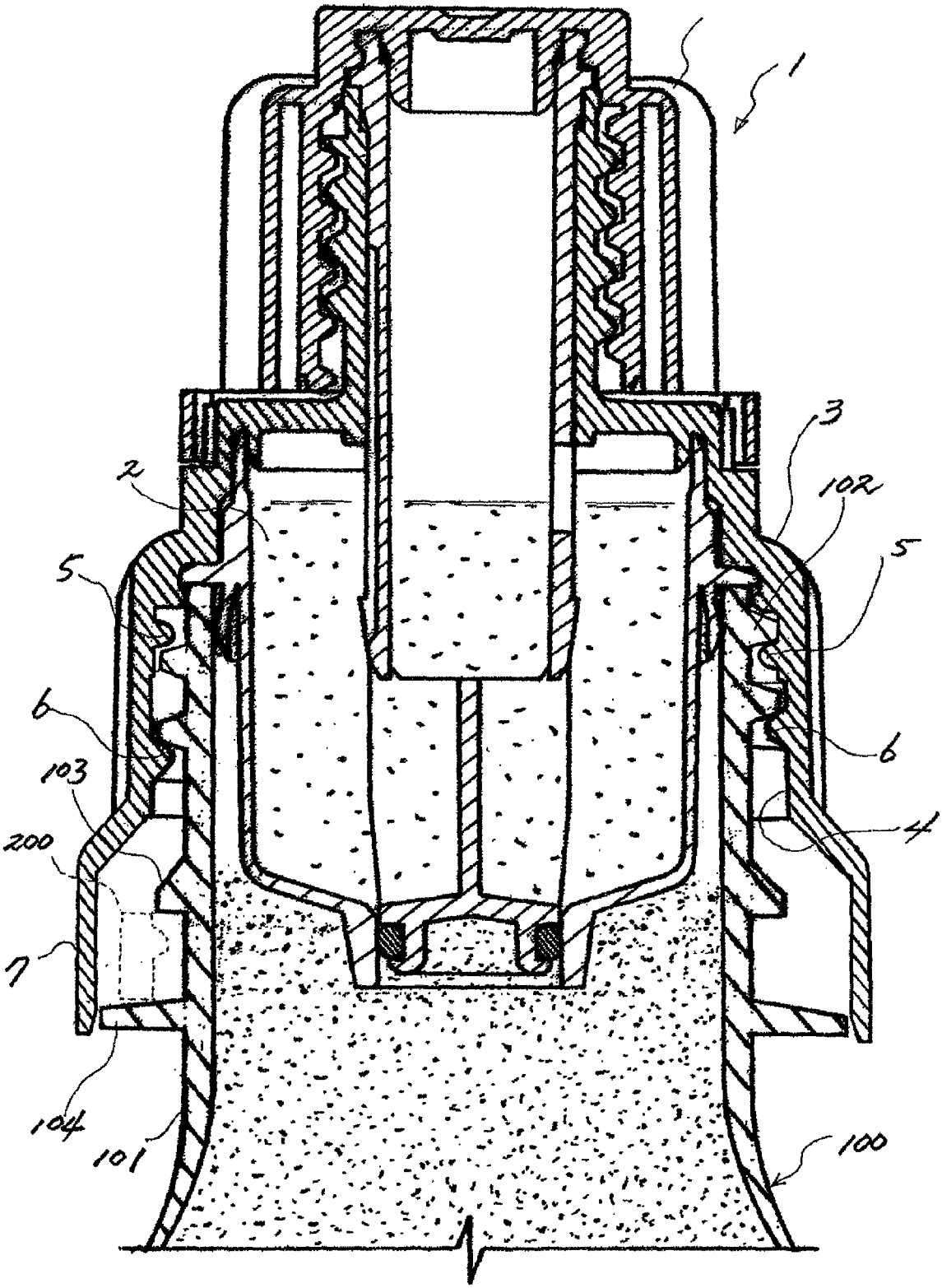

The operation examples of this invention recommended according to enclosed drawings or figures are as follows:

The FIG. 1 shows a recommended operation example of this invention. The bottle cap (1), this invention, is combined in the beverage container through the screw in principle. Also, above bottle cap (1) is flexibly designed to accommodate the storage space (2) or other secondary materials through the diverse designs. In addition, above bottle cap (1) consists of body (3) designed to be combined into the container neck (101) with screw thread (102) of container (100) in principle.

Two connection sections are positioned in the interior side (4) of body (3) forming a part of bottle cap (1). Above connection sections are positioned in the interior side (4) forming a part of top and bottom.

The connection sections positioned in above interior side (4) consists of top connection section (5) and bottom connection section (6). The screw thread of bottom connection section (6) is designed to be suitable for the big container neck (101). It is shown in the FIG. 1.

Also, the screw thread of top connection section (5) forming a part of bottle cap (1) is designed to be suitable for the narrow container neck (201). It is shown in the FIG. 2.

Above this invention is explained based on the container necks of 26.78 MM and 28.0 MM as follows: Top connection section (5) consists of screw thread designed to be caught and fixed by the screw thread of container neck (202) of 26.78 MM. Top connection section is positioned at the top. Bottom connection section (6) consists of screw thread designed to be caught and fixed by the screw thread of container neck (202) of 28.00 MM without influencing the operation of screw thread of container neck of 26.78 mm.

The bottle cap (1), this invention, is to be explained in detail as follows: If you combine the bottle cap (1), this invention, into the container (100) with container neck of 28.0 MM, top connection section (5) will be positioned in the place to partially wrap the screw thread of top container neck (102) as shown in the FIG. 1 and bottom connection section (6) will keep the sealing force by being strongly combined into the screw thread of bottom container neck (102).

The bottom section (7) positioned in the bottom of body (3) is assembled to wrap the round frame (104) together with skirt (200) remaining in the skirt catching jaw (103) of container (100).

If the bottle cap (1), this invention, is combined after removing the cap of bottle containing the portable water, skirt intended to prevent the fabrication (200) remains in the skirt catching jaw (103) of container (100). The bottom section of this invention is combined to wrap the skirt (200) and round frame (104).

Also, above bottom section (7) plays the role as a guide so that the bottle cap (1) may be correctly assembled in the container neck (101), so if the bottom section (7) is long, it is recommended. The bottom section may select or wrap the skirt (200) or round frame (104).

Figure 2:
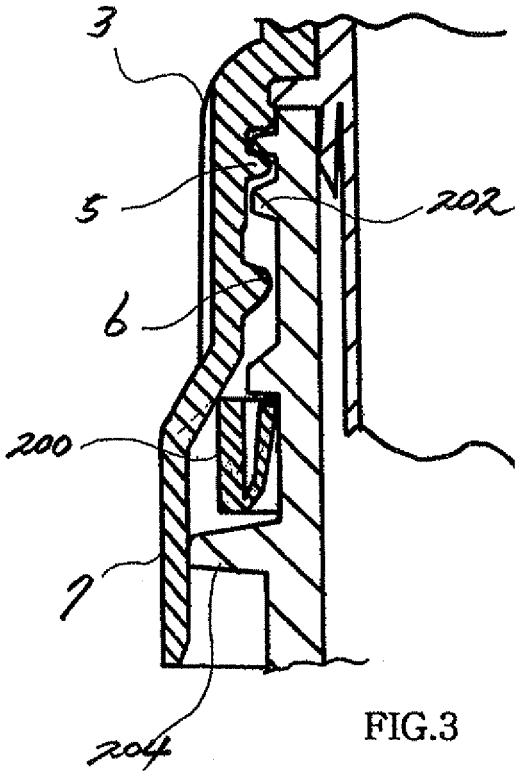

As other operation example, the FIG. 2 shows that the top connection section (5) is combined into the screw thread of narrow container neck (202). It is recommended that the bottom connection section (6) is positioned in the bottom space without touching the screw thread of container neck (202). Also, the bottom section (7) is assembled to wrap the skirt (200) or round frame (204).

In this regard, structure of above top connection section (5) and bottom connection section (6) is changeable according to size of container necks (101, 201). For an example, it is possible to position the top connection section (5) and bottom connection section (6) in the interior side (4) even if the size and shape are different as shown in the FIG. 3, or it is available to transform the connection sections. As a recommended example, accessory connection section (8), which is bigger than bop connection section and bottom connection section, is positioned to be combined into the container neck of different size in the bottom as shown in the FIG. 4.

It is recommended to design the accessory connection section (8) in the size and shape to be combined without influencing the container necks (101, 102).

Figure 5:
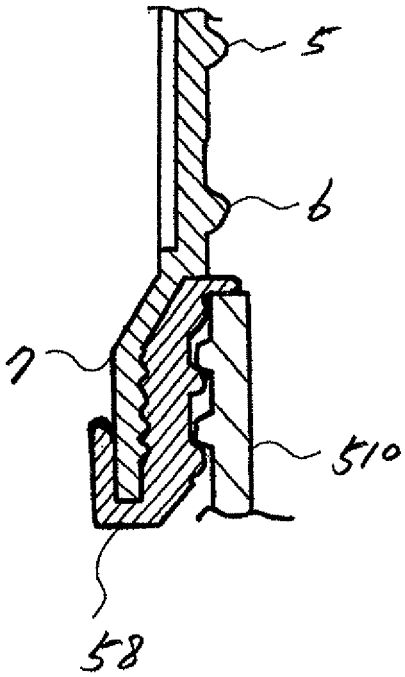

The FIG. 5 shows that the accessory connection section (58) is positioned to be assembled in other container neck (510) in the bottom section (7).

Figure 6:
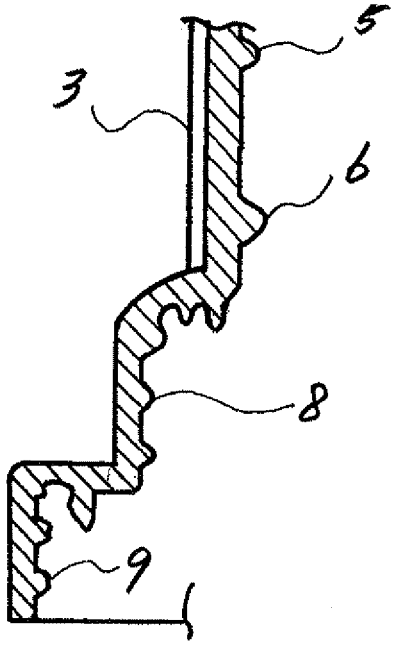
Figure 7:
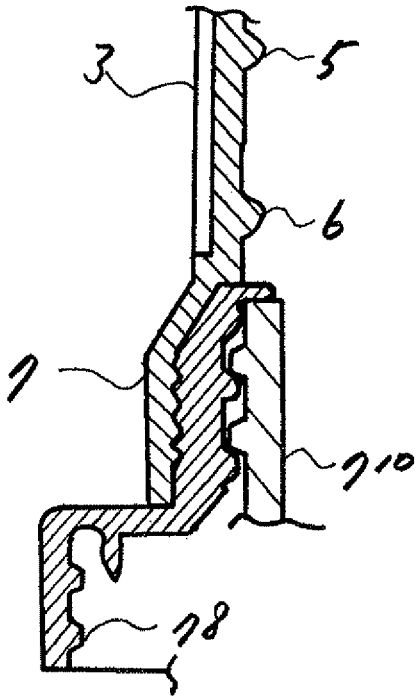

The FIGS. 6 and 7 show that two accessory connection sections (8 and 9) are positioned in the bottom of body (3). These figures also show that two assembling type accessory connection sections are positioned in the bottom.

Thus, the bottle cap, this invention, guarantees the diverse transformations. The FIG. 8 or 9 shows an example of transformation. The bottle cap guarantees other transformations. The FIG. 1 shows that the bottle cap is designed to mix and drop the contents contained in the storage space (2) in the container (100) when the top cap (10) is opened. The FIG. 8 also shows that the bottle cap is designed to mix and drop the contents contained in the storage space (2) in the container (100) when the top cap (11) is opened. The FIG. 9 shows that the content contained in the storage space (2) is dropped when the top cap is lifted (12).

INDUSTRIAL APPLICABILITY

This invention is on the bottle cap used for effectively mixing the concentrate and water or concentrate and general beverage or granule and water or powder and water. The bottle cap consists of three connection sections such as top connection section, bottom connection section and accessory connection section suitable for beverage or water container sold in the market, so its users may drink the beverage or water by dropping the contents in the container after removing the bottle cap connected to the container neck and then assembling the bottle cap, this invention.

The invention claimed is:

1. A bottle cap comprising:

a bottom connection section comprising a screw thread designed to be caught and fixed by a screw thread of a container neck having a first width;

a top connection section above the bottom connection section and comprising a screw thread positioned to be caught and fixed by a screw thread of a container neck having a second width, wherein the second width is narrower than the first width, wherein the top connection section is further sized and positioned so that the screw thread of the top connection section partially wraps the screw thread of the container neck having the first width; and a bottom section below the bottom connection section and extending radially outward relative to the bottom connection section to wrap around a skirt that is detached from a previous bottle cap.

2. The bottle cap of claim 1 wherein the screw thread of the top connection section is suitable for a screw thread of a container neck of 26.78 MM diameter.

3. The bottle cap stated of claim 1 wherein the screw thread of the bottom connection section is suitable for a screw thread of a container neck of 28.0 MM diameter.

4. The bottle cap of claim 1 wherein the bottom section is sized to wrap around a skirt of a previous bottle cap when the skirt is remaining in skirt catching jaws of the container.

5. The bottle cap of claim 4 wherein the bottom section is sized to wrap around a round frame of the container.

6. The bottle cap of claim 1 wherein the bottom section is sized to accommodate and seal an accessory connection section mounted to and sealing a neck of a container.

7. A bottle cap comprising:

a top cap;

a storage space containing secondary materials that drop into a container when the top cap is opened;

a top connection section comprising a screw thread positioned to be caught and fixed by a screw thread of a container neck of a first diameter when the bottle cap is mated to the container neck of the first diameter, wherein the top connection section is sized and positioned so that the screw thread of the top connection section at least partially wraps a screw thread of a container neck of a second diameter wider than the first diameter when the bottle cap is mated to the container neck of the second diameter; and a bottom connection section comprising a screw thread positioned to be caught and fixed by the screw thread of the container neck of the second diameter when the bottle cap is mated to the container neck of the second diameter.

8. The bottle cap of claim 7 further comprising a bottom section having a wider diameter than the bottom connection section so as to wrap around a bottle cap skirt.

9. The bottle cap of claim 8 wherein the bottom section diameter is sized to wrap a skirt remaining in skirt catching jaws of a container neck.

10. A bottle cap comprising:

a bottom connection section comprising a screw thread positioned to be caught and fixed by a screw thread of a container neck having a first width;

a top connection section above the bottom connection section and comprising a screw thread positioned to be caught and fixed by a screw thread of a container neck having a second width and wherein the screw thread of the top section partially wraps the screw thread of the container neck having the first width, wherein the second width is narrower than the first width; and a bottom section below the bottom connection section and extending radially outward relative to the bottom connection section to wrap around a skirt that is detached from a previous bottle cap.

* * * * *